United States Patent [19]

Tenthoff

[11] Patent Number: 4,689,157

[45] Date of Patent: Aug. 25, 1987

[54] METHOD OF AND DEVICE FOR CENTRIFUGALLY PURIFYING USED MINERAL OILS

[75] Inventor: Aloys Tenthoff, Oelde, Fed. Rep. of Germany

[73] Assignee: Westfalia Separator AG, Oelde, Fed. Rep. of Germany

[21] Appl. No.: 873,653

[22] Filed: Jun. 12, 1986

[30] Foreign Application Priority Data

Jul. 4, 1985 [DE] Fed. Rep. of Germany ..... 3523907

[51] Int. Cl.[4] ..... B04B 11/00

[52] U.S. Cl. ..... 210/787; 210/371

[58] Field of Search ..... 210/787, 789, 96.1, 210/360.1, 360.2, 371

[56] References Cited

U.S. PATENT DOCUMENTS 3,642,196 2/1972 Nilsson ..... 210/371

4,325,825 4/1982 Schötte ..... 210/371

*Primary Examiner*—Frank Sever

*Attorney, Agent, or Firm*—Sprung Horn Kramer & Woods

[57] ABSTRACT

The method is carried out with a self-emptying separator. Used mineral oil is supplied to its centrifuge drum through a central intake. Purified oil is extracted through a run-off. The separator also has another run-off for liquid extracted from the periphery of the drum. The second run-off is supplied from a sampler. A sensor is positioned in the second run-off. The sensor determines the consistency of the liquid. Downstream of the sensor is a water run-off valve. A line branches off between the sensor and the water run-off valve. The line is provided with a circulation-system valve and empties into the intake. When the circulation-system valve is open and the sensor determines from the consistency of the liquid flowing through the second run-off that the liquid is an emulsion of oil and water, it supplies the result to controls. The controls then close the circulation-system valve for a prescribed amount of time. Determination of the consistency of the liquid in the second run-off is continued at prescribed intervals of time by briefly opening the circulation-system valve until the liquid is determined to consist strictly of water. The circulation-system valve is then closed and the water run-off valve opened and kept open until the sensor determines a change in the consistency of the liquid.

3 Claims, 3 Drawing Figures

METHOD OF AND DEVICE FOR CENTRIFUGALLY PURIFYING USED MINERAL OILS

BACKGROUND OF THE INVENTION

The present invention relates to a method of centrifugally purifying used mineral oils, especially heavy oils contaminated with particles of dirt and slight amounts of water, by means of a self-emptying separator, with the mixture of solids and liquids being supplied to the separator's centrifuge drum through a central intake and with the purified oil being extracted from its center through a run-off, the separator also having another run-off supplied from a sampler for liquid extracted from the periphery of the drum, with a sensor positioned in the second run-off to determine the consistency of the fluid and with a water run-off valve downstream of the sensor, the liquid being returned to the intake when the water run-off valve is closed.

A method and device of this type are known from German OS No. 3 314 859. The sampler is the known device operates continuously and the liquid extracted from the periphery of the drum and supplied to the second run-off is either returned to the central drum intake or, if a sensor so determines, detoured out of the circulation system through a three-way valve.

As separation commences, oil flows into the second run-off through the run-off channel for the liquid extracted from the periphery of the drum and water accumulates in the drum's solids space. During this phase of the operation the three-way valve is positioned to return the oil to the drum's central intake. As soon as the water accumulated in the solids space arrives at the run-off channel, it is extracted through the channel and through the sampler and supplied to the second run-off. When the sensor, which can be an instrument that measures the electric conductivity of the liquid, determines that water instead of oil is flowing through the second run-off, the three-way valve is repositioned and the water is supplied to a catch point.

It has turned out in practice that a stable water phase cannot be extracted through the second run-off in accordance with the known method because the proportion of water in the intake into the drum is much lower than the run-off capacity of the amount of liquid extracted from the periphery of the drum. Thus, oil is also extracted along with the water, and both components emulsify, preventing separate diversion of the water phase. Emulsification is also promoted because the specific weights of oil and water differ so slightly and because liquid is constantly being extracted from the periphery of the drum through the sampler.

SUMMARY OF THE INVENTION

The object of the present invention is to improve a method of the aforesaid type to the extent that only water is extracted from the separator through the open water run-off valve and both the purified oil and the emulsion of oil and water that flow through the second run-off are returned to the central intake of the drum.

This object is attained in a method of the aforesaid type through an improvement wherein a line equipped with a circulation-system valve and emptying into the intake branches off between the sensor and the water run-off valve, the circulation-system valve and the water run-off valve are activated by controls, and the water run-off valve is closed when the circulation-system valve is open, wherein, as soon as the sensor determines from the consistency of the liquid flowing through the second run-off while the circulation-system valve is open that the liquid is an emulsion of oil and water, and transmits the result to the controls, the controls close the circulation-system valve for a prescribed length of time and the sensor continues to determine the consistency of the liquid in the second run-off at prescribed intervals of time with the circulation-system valve being opened briefly until the liquid is determined to be nothing but water, and wherein the controls then close the circulation-system valve and open the water run-off valve until the sensor determines a change in the consistency of the liquid, at which point the controls close the water run-off valve again and open the circulation-system valve at brief intervals to allow the sensor to carry out measurements at prescribed intervals.

In one practical embodiment of the method in accordance with the invention the circulation-system valve is opened while the water run-off valve is closed only for a limited time even during the stage of operation of the separator in which purified oil is being extracted through the second run-off, and sampling is continued at prescribed intervals of time.

The method in accordance with the invention is intermittent. The operating phases in which either the circulation-system valve or the water run-off valve is open alternate with phase in which both valves are closed. Since liquid is extracted from the periphery of the drum only at prescribed intervals of time, enough water to extract can accumulate in the drum, and the water level can shift radially inward in relation to the run-off channel. Since the sensor will detect only water during the following sampling process, the controls will open the water run-off valve and keep it open as long as pure water continues to run off, until, that is, the water level in the drum drops back to the level of the run-off in the drum. The water run-off valve is then closed and discontinuous liquid extraction recommenced.

In one preferred embodiment of the method, the circulation-system valve is kept open 15 seconds at a time and samples are obtained at intervals of 60 seconds.

The invention also relates to a device for carrying out the method, with a sensor that has a flow channel and measures the electric conductivity of the liquid, through an improvement wherein two bolt-shaped electrodes are positioned in the flow channel apart from and laterally displaced from each other in relation to the central axis of the channel.

The device can have a metal housing with a cylindrical chamber that accommodates a plastic casting that the flow channel extends through and that the electrodes are secured in.

The cross-section of the plastic casting in this embodiment can be a segment of a circle, the electrodes can be screws with their heads positioned outside a flattening and with the cable brackets for the electric connections secured in the vicinity of the heads, and the section of the chamber inside the housing that is demarcated by the flattening can be filled with plastic resin.

The device can also have at least one calibrated bore that determines how much liquid runs off and that is located in a sampler-chamber cover below the sampler.

The bores can have an inside thread, and one or more bores can be capable of being blocked off with a plug with an outside thread.

Some preferred embodiments of the invention will now be described with reference to the attached drawings, wherein

DETAILED DESCRIPTION OF THE PREFERRED EMBODIMENTS

Figure 1:
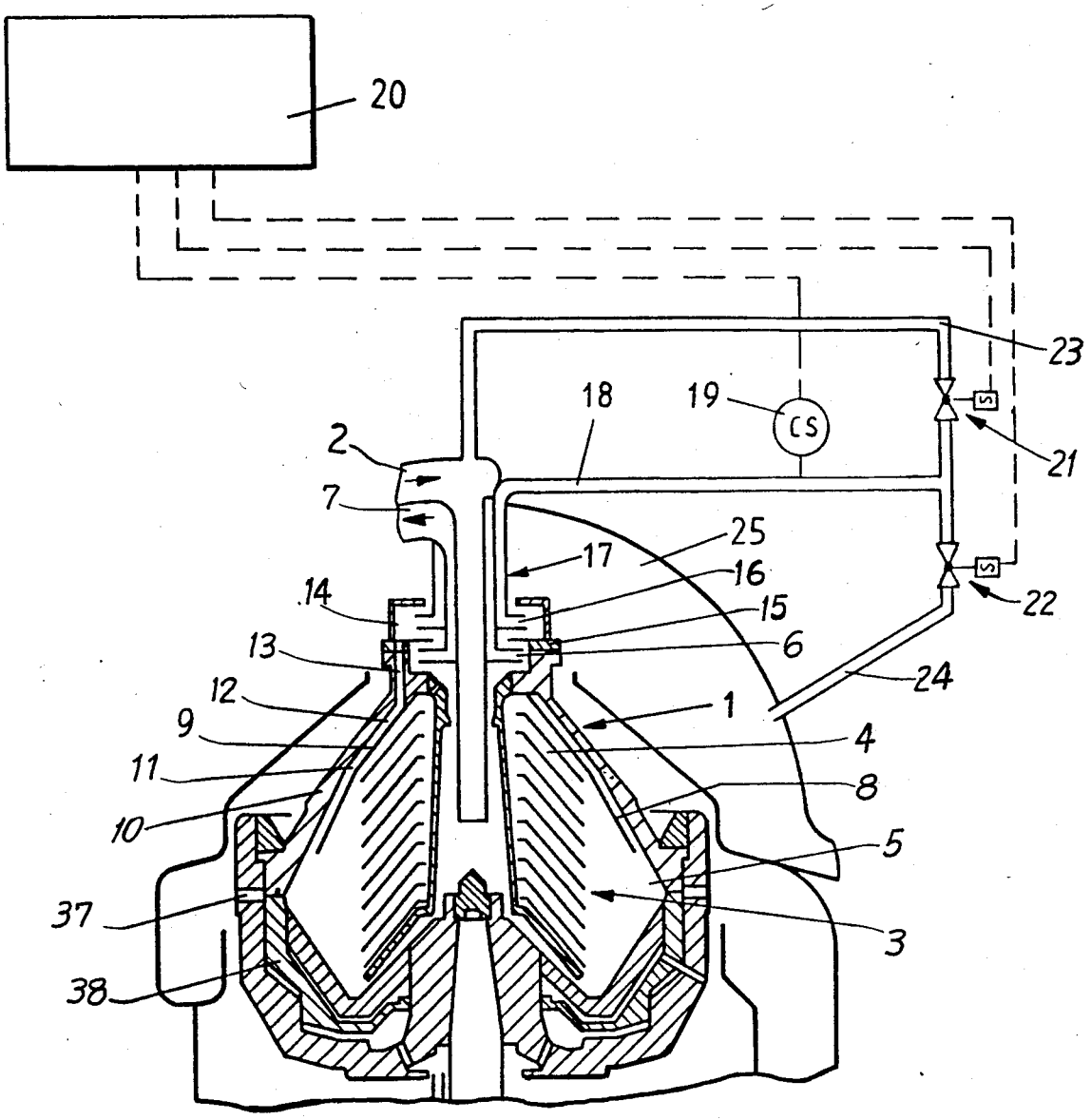
FIG. 1 is a vertical section through a clarifier-separator with associated controls.

As shown in FIG. 1, a separator has a centrifuge drum 1 that is supplied with a mxiture of solids and liquid, heavy oils contaminated with particles of dirt and slight amounts of water for instance, through a central intake 2. From intake 2 the mixture arrives in a centrifuging space 3 composed of a separation space 4 and a solids space 5. Purified oil is extracted from the center of the drum over a peeling disk 6 and through a run-off 7. The liquid, which can be oil, water, or an emulsion of these two liquid components, is extracted from the periphery of the drum in the illustrated embodiment through at least one bore 8 in a parting plate 9 located in the vicinity of the inside of drum cover 10 and constituting in conjunction with the cover an annular channel 11. From annular channel 11 the liquid flows through a channel 12, a bore 13, and a calibrated bore 14 that is positioned inside a sampler-chamber cover 15 and determines how much of the liquid can run off. Above sampler-chamber cover 15 is a sampler 17 that is provided with a peeling disk 16 and that the liquid flows through into another run-off 18.

Bore 8 constitutes the beginning and bore 14 the end of the channel that the liquid extracted from the periphery of the drum runs off through inside the drum. Sampler-chamber cover 15 can have several calibrated bores, each threaded so that they can easily be blocked off with a threaded plug, making it possible to vary how much liquid runs off. This is especially practical when the drum is used to separate other types of material.

Parting plate 9 can also have several bores 8 that can be blocked off with a plug so that the drum can easily be adapted for separating other types of material.

There is a sensor 19 in second run-off 18 that determines the consistency of the liquid flowing through the run-off. The results are supplied to controls 20 that open and close a circulation-system valve 21 and a water run-off valve 22. Circulation-system valve 21 is positioned in a line 23 that branches off from second run-off 18 between sensor 19 and water run-off valve 22 and empties into central intake 2. The water flows from water run-off valve 22 into a water-accumulation reservoir 39 through another line 24.

Figure 2:
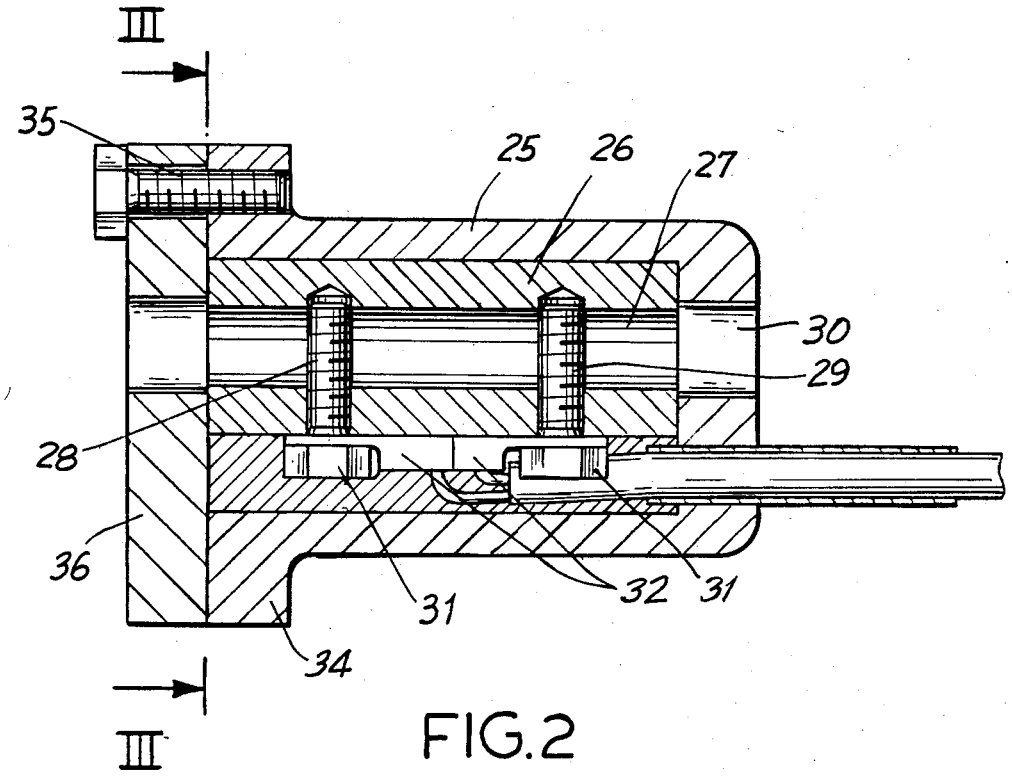
FIG. 2 is a longitudinal section through a sensor in the form of a conductimeter positioned in the second run-off.
Figure 3:
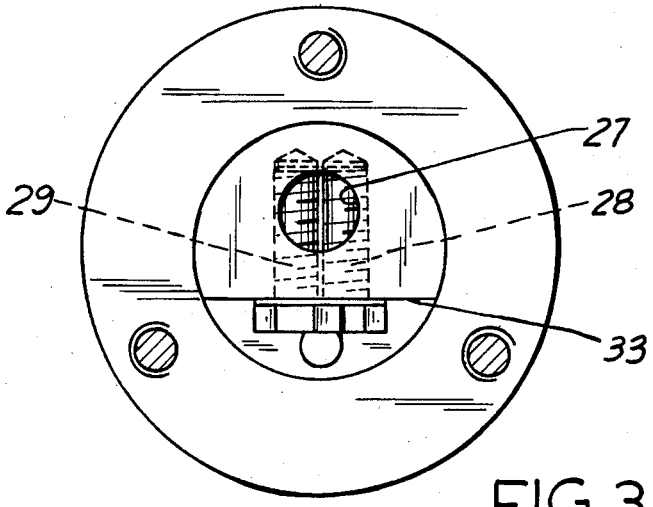
FIG. 3 is a section along the line III—III in FIG. 2.

The sensor 19 in the illustrated embodiment is a device that measures the electric conductivity of the liquid flowing through second run-off 18. The specifics of the design of this device will be evident from FIGS. 2 and 3. The device has a metal housing 25 equipped with a cylindrical chamber that accommodates a plastic casting 26. Casting 26 has a channel 27 for the liquid with the electric conductivity that is to be measured to flow through. To determine the conductivity the device has two bolt-shaped electrodes 28 and 29. Electrodes 28 and 29 are separated and laterally displaced in relation to the central axis 30 of flow channel 27.

Electrodes 28 and 29 are screws. Cable brackets 32 for the electric-connection lines are secured in the vicinity of the heads 31 of the screws. The cross-section of plastic casting 26 is a segment of a circle and has a flattening 33. Screw heads 31 and cable brackets 32 are positioned below flattening 33. The section of the chamber that accommodates flow channel 27 in housing 25 that is demarcated by flattening 33 and that is not occupied by casting 26 is filled with plastic resin, epoxide resin for example. Housing 25 has a flange 34, to which a terminal disk 36 is secured with screws 35. The channel 27 that the liquid with the conductivity that is to be measured flows through also extends through terminal disk 36 and through the wall of the channel that faces it.

This type of conductimeter is simple in design and allows for a small flow cross-section that no deposits can occur in.

Controls 20 can be set to carry out samplings by extracting liquid from the periphery of the drum through second run-off 18 at intervals of 60 seconds while the separator is in operation and to keep circulation-system valve 21 open 15 seconds at a time.

As soon as the water level in drum 1 reaches the bore 8 in parting plate 9, an emulsion of water and oil will flow through second run-off 18 during the next sampling and will be conveyed into central intake 2 through circulation-system valve 21 and line 23, with water run-off valve 22 closed. Once circulation-system valve 21 has been open for 15 seconds, it will close again and remain closed for 60 seconds, allowing water to accumulate in drum 1 again, so that the water level can shift radially in in relation to bore 8. During the next sampling pure water will flow through second run-off 18, and controls 20 will close circulation-system valve 21 and open water run-off valve 22, keeping it open until sensor 19 detects a change in the consistency of the liquid, sensing an emulsion of water and oil.

The solids space 5 of the drum 1 illstrated in FIG. 1 has expulsion apertures 37 around it that can be blocked off and released by an axially moving piston slide 38.

It will be appreciated that the instant specification and claims are set forth by way of illustration and not limitation, and that various modifications and changes may be made without departing from the spirit and scope of the present invention.

What is claimed is:

1. In a method of centrifugally purifying used mineral oils comprising a mixture of oil contaminated with particles of dirt and slight amounts of water, by supplying the mixture of solids and liquids to a centrifuge drum of a self-emptying separator through a central intake, extracting the purified oil from the center of the drum through a run-off, extracting liquid from the periphery of the drum via a sampler through a second run-off with a sensor positioned in the second run-off to determine the consistency of the liquid and with a water run-off valve downstream of the sensor and returning liquid to the intake when the water run-off valve is closed, the improvement comprising: disposing a circulation-system valve in a line emptying into the intake and branching off between the sensor and the water run-off valve, closing the water run-off valve when the circulation-system valve is open, to enable the sensor to determine from the consistency of the liquid flowing through the second run-off while the circulation-system valve is open if the liquid is an emulsion of oil and water, closing the circulation-system valve for a prescribed length of time when an emulsion of oil and water is sensed and enabling the sensor to continue to determine the consistency of the liquid in the second run-off at prescribed intervals of time by briefly opening the circulation-system valve until the liquid is determined to be nothing but water, and closing the circulation-system valve and opening the water run-off valve until the sensor determines a change in the consistency of the liquid, and thereafter closing the water run-off valve again and opening the circulation-system valve at brief intervals to allow the sensor to carry out measurements at prescribed intervals.

2. The method as in claim 1, wherein the circulation-system valve is opened while the water run-off valve is closed only for a limited time even when purified oil is being extracted through the second run-off, and sampling is continued at prescribed intervals of time.

3. The method as in claim 1, wherein the circulation-system valve is kept open 15 seconds at a time and samples are obtained at intervals of 60 seconds.

* * * * *

UNITED STATES PATENT AND TRADEMARK OFFICE

CERTIFICATE OF CORRECTION

PATENT NO. : 4,689,157

DATED : August 25, 1987

INVENTOR(S) : Aloys Tenthoff

It is certified that error appears in the above-identified patent and that said Letters Patent is hereby corrected as shown below:

Fig. 1 Delete "25" and substitute --39--

Signed and Sealed this

Tenth Day of May, 1988

*Attest:*

*Attesting Officer*

DONALD J. QUIGG

*Commissioner of Patents and Trademarks*